United States Patent [19]

Seese et al.

[11] Patent Number: 4,765,172

[45] Date of Patent: Aug. 23, 1988

[54] METHOD AND TOOLS FOR FORMING SEWING MACHINE BINDER STRIP FOLDERS

[75] Inventors: Theodore A. Seese, Baldwin Park; Subramanian Narayanan, Rowland Heights; Gilbert A. Flores, Whittier, all of Calif.

[73] Assignee: SGT Folders Unlimited, Inc., Rowland Heights, Calif.

[21] Appl. No.: 933,788

[22] Filed: Nov. 24, 1986

[51] Int. Cl.[4] ..... B21D 53/00

[52] U.S. Cl. ..... 72/322; 72/379; 72/387; 112/147

[58] Field of Search ..... 112/138, 147; 493/440; 72/316, 322, 387, 457, 460

[56] References Cited

U.S. PATENT DOCUMENTS

| | | | |
|---|---|---|---|
| 67,358 | 7/1867 | Serviss | 72/322 |
| 166,161 | 7/1875 | Trowbridge | 112/147 |
| 780,559 | 1/1905 | Farmer | 493/440 |
| 2,701,001 | 2/1955 | James | 72/387 |
| 3,583,199 | 6/1971 | Speiser | 72/387 |
| 4,184,439 | 1/1980 | Schulz | 112/147 |
| 4,280,421 | 7/1981 | Price | 112/147 |

*Primary Examiner*—Lowell A. Larson
*Attorney, Agent, or Firm*—Boniard I. Brown

[57] ABSTRACT

A method of and tools for forming sewing machine binder strip folders for folding a cloth binder strip laterally as it is fed to the sewing machine needle for stitching the folded binder strip to fabric which is fed past the needle with the folded strip. The folder is formed from a flat bendable sheet by folding longitudinal edge portions of the sheet inwardly over the same side of the sheet to form the latter to an initial configuration having inwardly opening binder strip receiving channels along the longitudinal edges of the sheet, and then bending the longitudinal central portion of the sheet laterally and progressively from one end of the sheet while retaining the opposite end of the sheet in its initial configuration to (a) form a longitudinally extending and tapered center fold in the sheet, (b) form said one end of the sheet into a narrowed mouth, and (c) twist the channels of the sheet about longitudinal axis, whereby the mouth ends of th channels are angularlay displaced relative to their opposite coplanar ends.

9 Claims, 8 Drawing Sheets

FIG. 1
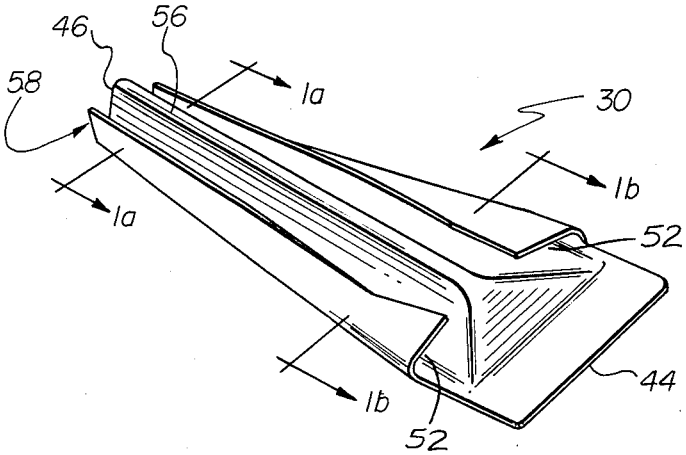
FIG. 1a
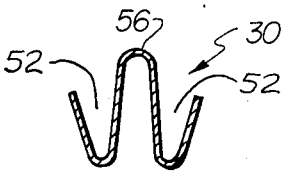
FIG. 1b
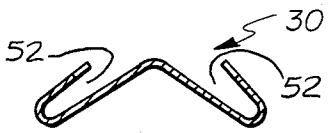
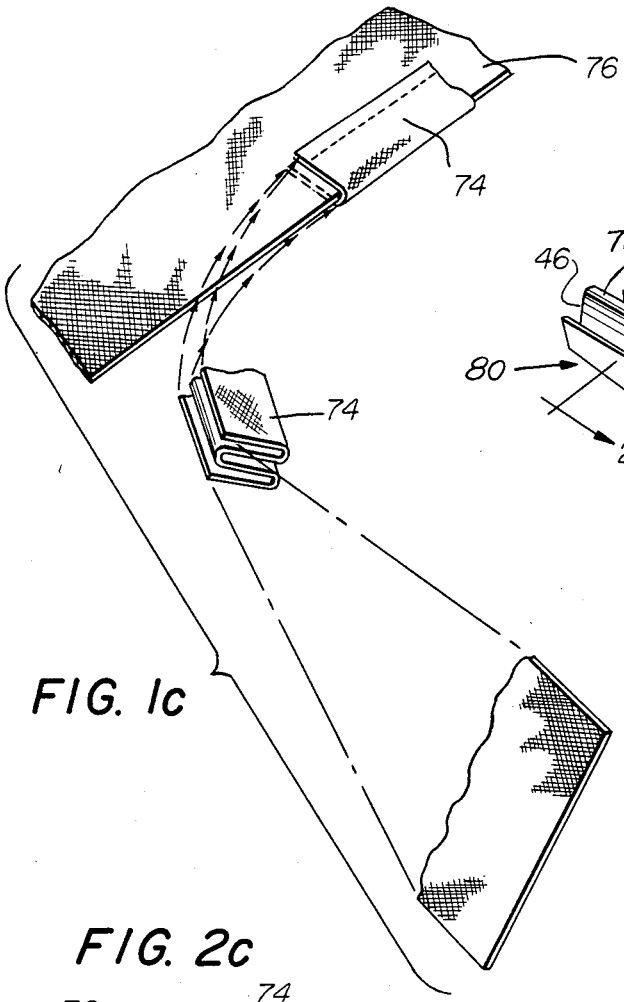
FIG. 1c
FIG. 2
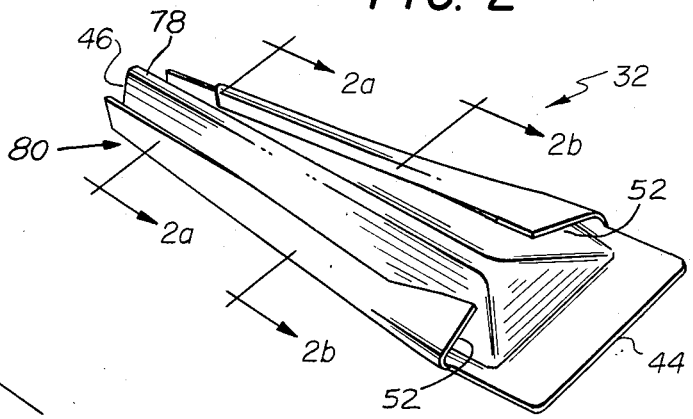
FIG. 2a
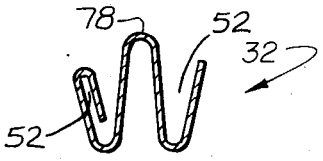
FIG. 2b
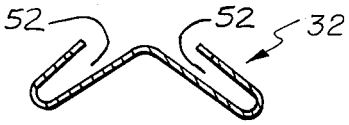
FIG. 2c
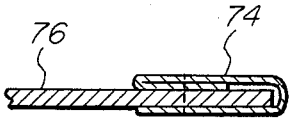

METHOD AND TOOLS FOR FORMING SEWING MACHINE BINDER STRIP FOLDERS

BACKGROUND OF THE INVENTION

1. Field of the Invention

This invention relates generally to the sewing art and more particularly to a method of and tools for forming sewing machine binder strip folders.

2. Prior Art

The manufacture of clothing and other fabric items often involves the stitching of a cloth binder strip to the fabric. In some cases, the binder strip is sewn to an edge of the fabric to finish the edge. In this case, the binder strip may be folded laterally about the edge. In other cases, the binder strip may be sewn to fabric for a purpose other than finishing an edge of the fabric. In any event, the present invention is concerned with those binder strip stitching applications which require lateral folding of the binder before it is stitched to the fabric.

When stitching a binder strip to an edge of fabric to finish the edge, for example, the binder strip may be folded about the edge so that the fabric edge is disposed within the binder folder. In other cases, the folded binder is applied entirely to one side of the fabric.

Binder strip folders may be designed to produce a wide variety of binder strip folds. The present invention will be described in connection with binder strip folds referred to herein as single, single/double and double/-double folds. In a single fold, the binder strip is essentially folded in half along its longitudinal center line. The single/double fold is similar to the single fold except that one side of the single fold is essentially folded on itself along a longitudinal fold line of the binder strip. In a double/double fold, each side of the single fold is folded on itself along a longitudinal center line of the binder strip.

Sewing machine folder attachments exist for folding a binder strip as the latter is fed to the sewing machine needle along with the fabric to which the binder strip is stitched. These folders may be designed to form the single, single/double, and double/double folds just mentioned. These existing folding attachments, however, are costly, difficult and time-consuming if not impossible to obtain, and are otherwise less than totally satisfactory from the standpoint of the end user. Accordingly, a definite need exists for a better way of providing binder folders to the end user. The present invention satisfies this need.

SUMMARY OF THE INVENTION

Simply stated, the present invention provides novel methods of and tools which may be utilized by the end user, i.e., clothing manufacturers, to form binder folders of the class described. These binder folders are then fitted with various other elements, including mounting brackets for mounting the folders on a sewing machine.

This invention is concerned only with forming the body of the binder strip folder which is then provided with a mounting bracket and the other elements necessary to form a completed binder folder attachment. For this reason, the ensuing description will be devoted primarily to the present methods and tooling for forming the folder body with only brief discussion of the additional procedures and elements necessary to complete the folder attachments and ready them for attachment to a sewing machine. For convenience, in this description, the folder body will be referred to simply as a folder.

It should also be noted at the outset that the tooling of the invention may be used to form a wide variety of binder folder shapes. Only some of these will be described. Accordingly, the invention should not be regarded as limited to forming these described folders.

According to the present invention, a binder folder is formed from a thin flat relatively firm but bendable blank referred to herein as a sheet. The preferred material of this sheet is thin sheet metal such as nickel silver and stainless steel folder stock. In the initial step of the present folder forming method, longitudinal edge portions of this sheet are bent inwardly over the same side of the sheet to form the latter into an initial configuration. In this initial configuration, the sheet has coplanar, longitudinal edge channels opening laterally inward toward one another and a relatively flat intervening central sheet portion disposed in a plane parallel to the common plane of the edge channels. The width of these edge channels normal to their common plane approximates the thickness of the binder strip to be folded. The width of the initially folded sheet, between the outer longitudinal edge walls of the edge channels, approximates the width of the binder strip. The folded sheet is thus configured to receive a binder strip endwise with the longitudinal strip edge portions positioned within the channels.

In the next step of the folder forming method, the longitudinal central portion of the initially folded sheet is bent laterally and progressively from one end of the sheet while retaining the opposite end of the sheet in its initial configuration wherein the respective channel end portions are substantially coplanar and parallel to the intervening central portion of the sheet. This latter bending step is performed in such a way as to form the central portion of the sheet into a laterally curved, longitudinally extending and tapered center fold and to twist the longitudinal edge channels substantially about their longitudinal axis. The end product of this bending step is a folder having a laterally narrowed mouth at said one end of the sheet, a longitudinally tapered center fold which tapers to a decreasing height and increasing width towards the opposite end of the sheet, and twisted edge channels whose ends adjacent the mouth of folder are angularly displaced relative to their opposite coplanar ends.

The folder thus formed is adapted to receive a cloth binder strip endwise through the end of the folder adjacent the coplanar channel end portions. For convenience, this end of the folder is referred to as its infeed end. The opposite end of the folder, which forms the folder mouth, is referred to as its outfeed end.

In use, the folder is mounted on a sewing machine adjacent the sewing machine needle. A cloth binder strip is fed endwise through the folder from its infeed end to its outfeed end with the binder strip edges positioned within the folder edge channels. As the binder strip emerges from the outfeed end of the folder, it passes under the sewing needle in stitching relation to fabric which is fed past the needle with the folded binder. As the binder strip passes through and then emerges from the folder under the sewing needle, the strip is folded laterally with the desired fold pattern. As noted earlier, the present invention will be described in connection with three binder strip fold patterns, namely single fold, single/double fold, and double/double fold.

According to the present invention, the single fold folder is formed by folding the longitudinal edge portions of the folder sheet to form the longitudinal edge channels of the folder. The central portion of the sheet is then bent laterally and progressively from the folder outfeed end towards its infeed end to form a longitudinally extending and tapered center fold which progressively decreases in height and increases in width toward the infeed end of the folder.

A single/double folder is formed by folding the longitudinal edge portion of the sheet inwardly over the same side of the sheet, in the same manner as in the formation of a single fold folder. Thereafter, one folded longitudinal edge portion of the sheet is folded on itself progressively from the outfeed end of the folder, after which the tapered center fold is formed. The double/-double fold folder is formed in the same way as the single/double folder except that both folded longitudinal edge portions of the sheet are folded inwardly on themselves, progressively from the outfeed end of the sheet, before forming the longitudinal center fold on the sheet.

A second aspect of the invention is concerned with tooling for performing the folder forming method of the invention. One tool according to the invention is a primary and secondary bending tool which is used to fold the longitudinal edge portions of the folder sheet in a primary bending operation to form the longitudinal edge channels of the folder. The same tool is used to progressively fold ono or both longitudinally folded edge portions of the sheet in a secondary bending operation in the manner involved in forming the single/double and double/double fold folders. This primary, secondary bending tool has a forming blade and a backing blade between which the folder sheet may be gripped. In the primary bending operation, the sheet is gripped between the forming and backing blades with first one longitudinal edge portion and then the other longitudinal edge portion projecting beyond an edge of the forming blade. The projecting longitudinal edge portions of the sheet are bent over the longitudinal edges of the forming blade to form the sheet to its initial configuration.

To enable the tool to function as a secondary bending tool, the forming blade has a tapered end which is sized and shaped to fit within one end of the initially formed longitudinal edge channels in the sheet. In the secondary bending operation, a folder sheet which has been bent to its initial configuration, is clamped between the forming blade and backing blade with one folded edge portion projecting beyond an edge of the forming blade and the tapered shoulders of the forming blade engaging in the coplanar infeed ends of the sheet edge channels. The projecting folded edge portion of the sheet is then progressively folded from the outfeed end of the sheet while the opposite infeed end of the sheet is retained in its initial configuration wherein the respective channel end portions are coplanar and parallel to the intervening central portion of the sheet.

A second tool according to the invention is a center bending tool having a pair of pivoted arms, one including a longitudinal forming cavity and the other including a longitudinal forming blade engageable within the cavity. The forming blade has laterally projecting wings which are slotted to receive the infeed end of the initially folded folder sheet.

In use of the center bending tool, a folder sheet which has been bent to its initial configuration using the primary bending tool is placed in the center bending tool with the flat central portion of the sheet positioned between the forming blade and forming cavity of the tool. The infeed end of the sheet is inserted into the slotted wings of the forming blade. The arms of the forming tool are then moved together to force the forming blade into the forming cavity. The forming bar and cavity are sized and shaped to form the tapered center fold in the central portion of the folded sheet and to simulatenously and progressively twist the folded longitudinal edge portions of the sheet.

BRIEF DESCRIPTION OF THE DRAWINGS

FIG. 1 is a perspective view of a single fold binder strip folder according to the invention;

FIG. 1*a* is a section taken on line 1*a*—1*a* in FIG. 1;

FIG. 1*b* is a section taken on line 1*b*—1*b* in FIG. 1;

FIG. 1*c* diagrammatically illustrates a single binder fold produced by the single fold binder folder in FIG. 1;

FIG. 2 is a perspective view of a single/double fold binder strip folder according to the invention;

FIG. 2*a* is a section taken on line 2*a*—2*a* in FIG. 2;

FIG. 2*b* is a section taken on line 2*b*—2*b* in FIG. 2;

FIG. 2*c* illustrates a single/double binder fold produced by the single/double binder folder of FIG. 2;

PREFERRED EMBODIMENTS

Figure 3:
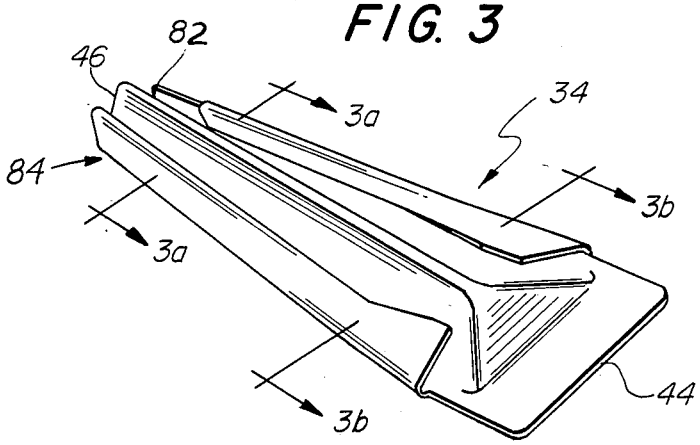
FIG. 3 is a perspective view of a double/double fold binder strip folder according to the invention.
Figure 3A:
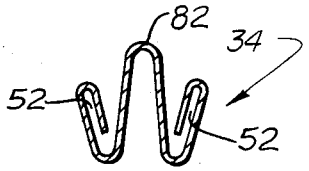
FIG. 3*a* is a section taken on line 3*a*—3*a* in FIG. 3.
Figure 3B:
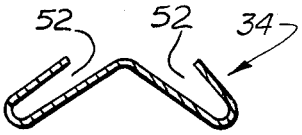
FIG. 3*b* is a section taken on line 3*b*—3*b* in FIG. 3.
Figure 4:
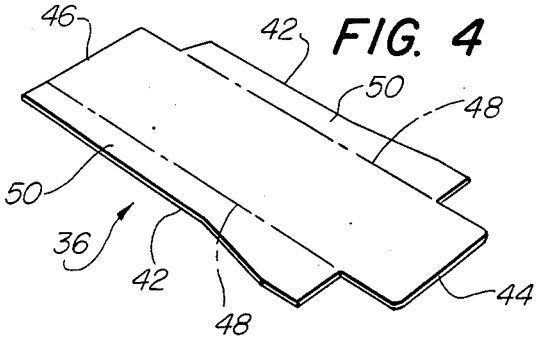
FIG. 4 is a perspective view of a pattern sheet from which the single fold folder of FIG. 1 is formed.
Figure 5:
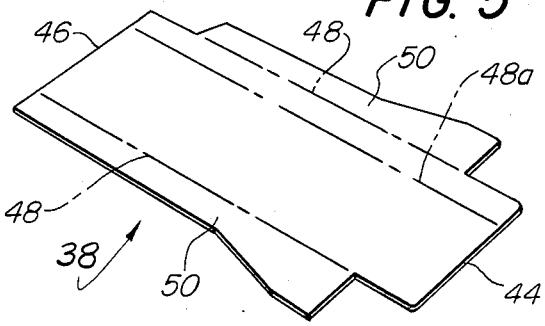
FIG. 5 is a perspective view of the pattern sheet from which the single/double fold folder of FIG. 2 is formed.
Figure 6:
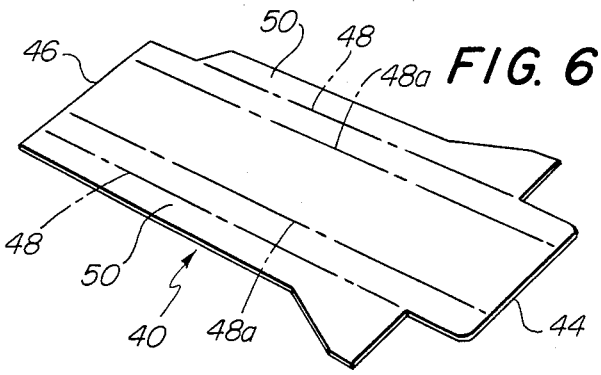
FIG. 6 is a perspective view of the pattern sheet from which the double/double fold folder of FIG. 3 is formed.

Reference is made first to FIGS. 1 through 3 illustrating folders 30, 32, and 34 which have been formed in accordance with the invention and to FIGS. 4 through 6 illustrating blanks or pattern sheets 36, 38, 40 from which these folders are formed. The folders 30, 32, and 34 have the three fold patterns mentioned earlier, namely single fold (folder 30), single/double fold (folder 32), and double/double fold (folder 34). The pattern sheets 36, 38, 40 from which the folders are formed is a relatively thin stiff but bendable sheet material. The preferred sheet material is thin sheet metal, such as nickel, silver, and stainless steel folder stock.

Pattern sheet 36 from which the single fold folder 30 of FIG. 1 is formed is generally rectangular in shape and had longitudinal edges 42 and opposite ends 44, 46. The sheet has two longitudinal fold lines 48 which define with their respective longitudinal sheet edges 42 longitudinal edge portions 50. Pattern sheet 38 from which the single/double folder 32 is formed is similar to sheet 30 except that in addition to the fold lines 48, which in this case constitute primary fold lines, the sheet 38 has an additional, secondary fold line 48*a* between and parallel to the primary fold lines 48. Pattern sheet 40 from which the double/double fold folder 34 is formed is similar to the single/double folder pattern sheet 38 except that sheet 40 has two secondary fold lines 48*a*.

Figure 7:
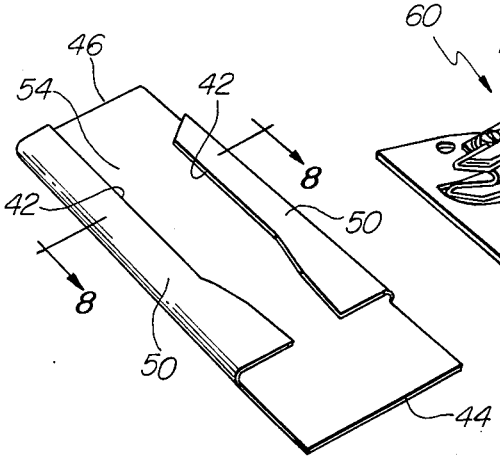
FIG. 7 is a perspective view illustrating an initial configuration into which all of the pattern sheets of FIGS. 4–6 are formed by initial primary bends involved in forming the respective binder folders of FIGS. 1–3.

According to the present invention, the single fold binder folder 30 of FIG. 1 is formed by first bending the longitudinal edge portion 50 of its respective pattern sheet 36 inwardly about the fold lines 48 and over the same side of the sheet to the initial sheet configuration of FIG. 7. In this initial configuration of FIG. 7, the pattern sheet 36 has coplanar longitudinal edge channels 52 which open inwardly toward one another and an intervening flat central sheet portion 54 parallel to the common plane of the edge channels 52. The width of the channels 52 normal to their common plane approximate the thickness of the binder strip to be folded. The lateral width of the folded sheet of FIG. 7, between the outer longitudinal edges of its channels 52, approximates the width of the binder strip to be folded.

The next step in forming the folder 30 of FIG. 1 is a center bending step. This step involves bending the central portion 54 of the initially folded pattern sheet in FIG. 7 laterally and progressively from the sheet end 46 toward the sheet end 44 while retaining the latter sheet end portion in its initial configuration of FIG. 7. As noted, in this initial configuration, the respective end portions of the sheet edge channels 52 are coplanar and the intervening central sheet end portion is flat and disposed in a plane parallel to the common plane of the edge channels.

The end product of this center bending operation is the single fold folder 30 of FIG. 1. As will be explained presently, the binder strip to be folded is fed endwise through the folder from its end 44 to its end 46. For this reason, in the following description, the folder end 44 is referred to as its infeed end. The folder end 46 is referred to as its outfeed end.

The center bending operation is performed in a manner to accomplish three results. First, the central portion 54 of the initially folded pattern sheet in FIG. 7 is bent laterally to form a laterally curved, longitudinally extending and tapered center fold 56. Secondly, the outfeed end 46 of the pattern sheet is narrowed to form a mouth 58. Thirdly, the longitudinal edge channels 52 are effectively twisted substantially about their longitudinal axes. The center fold 56 is longitudinally tapered to progressively decrease in height and increase in width from the outfeed end 46 toward the infeed end 44 of the folder. The longitudinal edge channels 52 are effectively twisted about 90° about their longitudinal axes so that their outfeed ends are angularly displaced relative to their coplanar infeed ends by an angle approximating 90° or slightly less.

Figure 9:
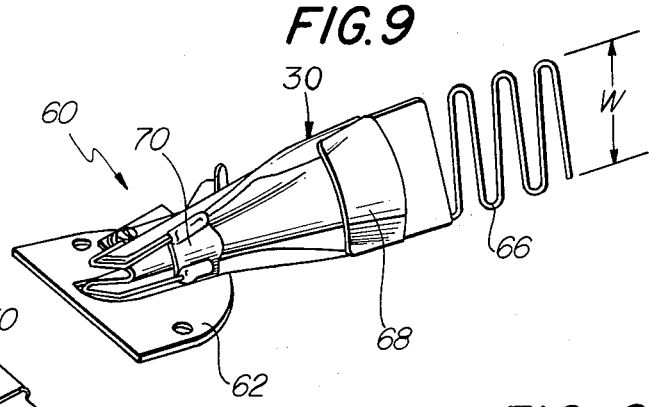
FIG. 9 is a perspective view on reduced scale of a complete binder folder attachment embodying the single fold folder of FIG. 1.
Figure 8:
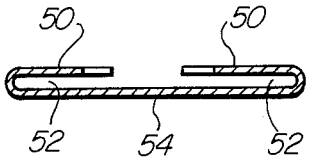
FIG. 8 is a section taken on line 8—8 in FIG. 7.
Figure 10:
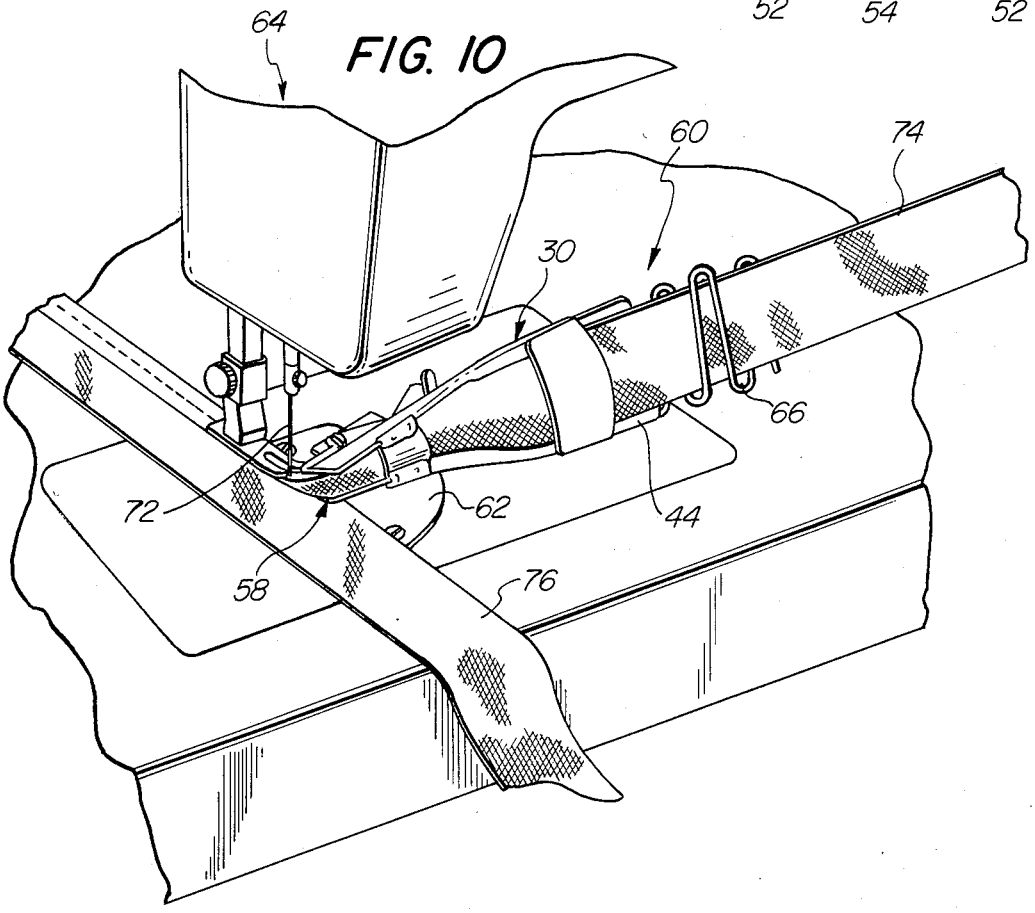
FIG. 10 illustrates the binder folder attachment of FIG. 9 installed in a sewing machine.

FIGS. 9 and 10 illustrate a complete folder attachment 60 including the single fold folder 30. This folder attachment has certain additional elements including a mounting bracket or plate 62 for attaching the folder to a sewing machine 64. As mentioned earlier, the present invention is concerned primarily with forming the folder 30 and, therefore, the additional elements of the completed folder attachment will not be described in detail. Suffice it to say that the illustrated folder attachment 60 includes a serpentine spring 66 attached to the infeed end 44 of the folder 30 and binder retaining plates 68, 70 spanning the side of the folder across which the binder strip passes. The mounting plate 62 mounts the folder 30 on the sewing machine 64 just ahead of the sewing machine needle 72. A binder strip 74 to be folded is threaded through the spring 66 and then through the folder 30 from its infeed end 44 to its outfeed mouth 58. The binder emerges laterally from the folder mouth 58 and then passes under the sewing needle 72 along with the fabric 76 to which the binder is stitched.

The infeed spring 66 maintains a light restraining force on the binder 74 to create an appropriate light endwise tension in the binder. As the binder passes through the folder 30, the binder is folded laterally in such a way that as it emerges from the folder mouth 58 it is effectively folded in half about its longitudinal center line, as shown in FIG. 1*c*. In this particular case, the binder is folded about an edge of the fabric 76 to which it is then stitched as the binder and fabric pass under the sewing needle 72. The entire folded binder, however, could be fed to one side of the fabric.

The single/double folder 32 of FIG. 2 is formed from the pattern sheet 38 of FIG. 5. The folder is formed by first folding the longitudinal edge portions of the sheet about its primary fold lines 48 and inwardly over the same side of the sheet, in the same primary bending operation as described in connection with the folder 30, to form the pattern sheet to the initial configuration of FIG. 7. The secondary fold line 48 of the pattern sheet 38 is located slightly inward of the innermost longitudinal edge of one folded sheet edge portion 50. In a secondary bending operation, the latter, adjacent folded sheet edge portion is folded inwardly about the secondary fold line 48*a* and progressively from the outfeed end 46 of the sheet. The secondary folding operation effectively twists the respective longitudinal edge channel of the sheet approximately 180° substantially about the longitudinal axis of the channel and forms the pattern sheet 38 into its intermediate folded configuration of FIG. 11.

Figure 11:
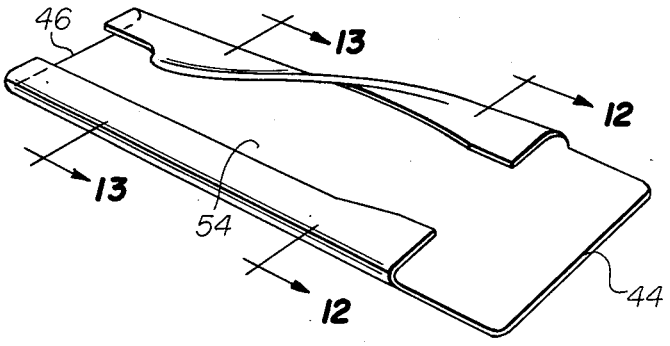
FIG. 11 is a perspective view of the single/double folder pattern sheet of FIG. 5 after a secondary bending operation has been performed on the sheet.
Figure 12:
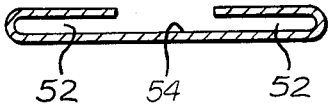
FIG. 12 is a section taken on line 12—12 in FIG. 11.
Figure 13:
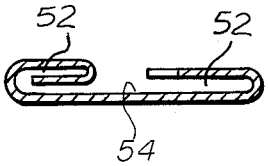
FIG. 13 is a section taken on line 13—13 in FIG. 11.

The final step in forming the single/double fold folder 32 involves essentially the same center bending operation as described in connection with the single fold folder 30. Thus, in this final step, the central portion 54 of the pattern sheet in FIG. 11 is bent laterally and progressively from the outfeed sheet end 46 toward the infeed sheet end 44 while retaining the latter sheet in its initial configuration of FIG. 7. In this initial configuration, the infeed end portions of the channels 52 are coplanar and parallel to the intervening flat sheet portion 54.

This final center bending operation is performed in much the same way as was the final center bending operation for the folder 30. Thus, the final center bending operation forms the central portion 54 of the folded pattern sheet 38 in FIG. 11 into a laterally curved, longitudinally extending and tapered center fold 78, narrows the outfeed end of the sheet into a mouth 80, and effectively twists the outfeed ends of both longitudinal edge channels 52 approximately 90° about their longitudinal axes to form the folder 32 of FIG. 2. The outfeed end of the double-folded edge channel is thereby angularly displaced approximately 270° relative to its infeed end. As in the case of the center fold 56 of the folder 30, the center fold 78 of folder 32 progressively decreases in heght and increases in width from the outfeed end 46 toward the infeed end 44 of the folder 32.

As in the case of the single fold folder 30 of FIG. 1, a binder strip 74 to be folded is fed endwise through the single/double fold folder 32 from its infeed end 44 to its outfeed mouth 80 and then laterally to the sewing needle along with the fabric to which the binder is to be stitched. Folder 32 forms the binder to its single/double fold configuration of FIG. 2*c*.

Figure 3C:
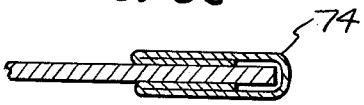
FIG. 3*c* illustrates a double/double binder fold produced by the double/double binder folder of FIG. 3.
Figure 14:
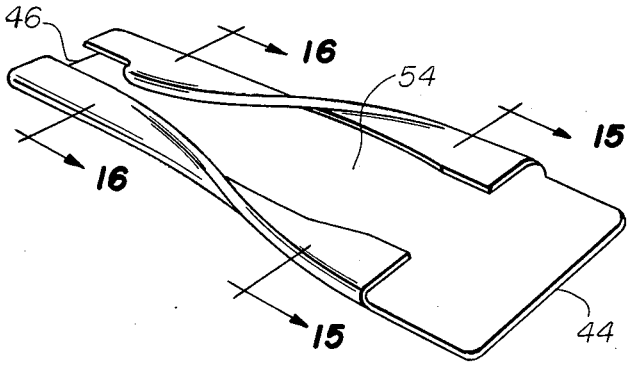
FIG. 14 is a perspective view of the double/double folder pattern sheet of FIG. 6 after two secondary bending operations have been performed on the sheet.
Figure 15:
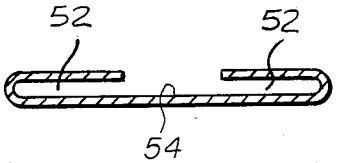
FIG. 15 is a section taken on line 15—15 in FIG. 14.
Figure 16:
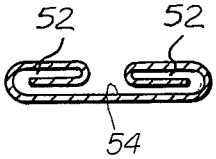
FIG. 16 is a section taken on line 16—16 in FIG. 14.
Figure 17:
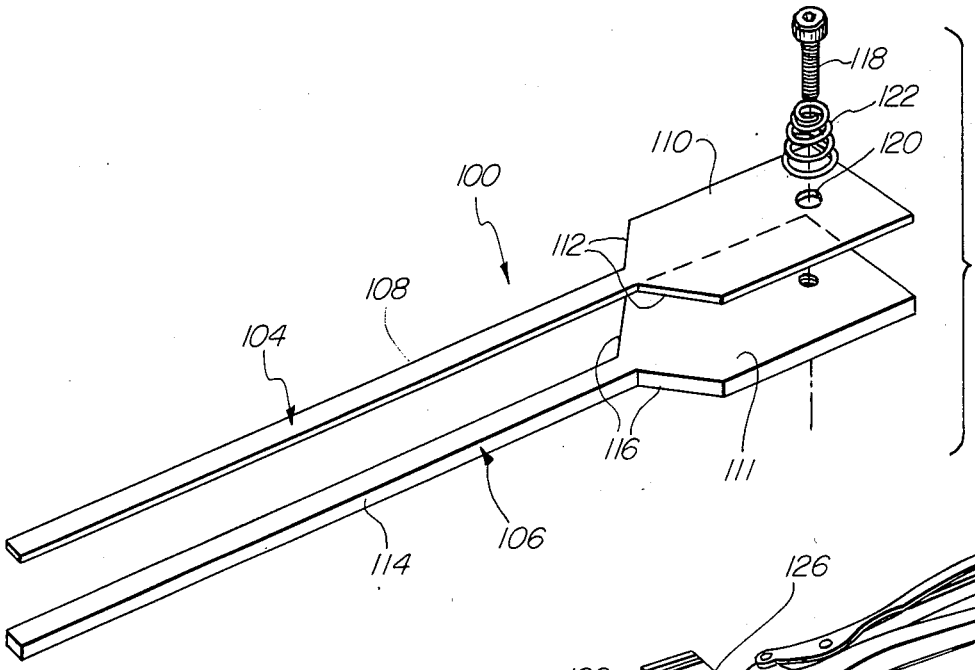
FIG. 17 is an exploded perspective view of a primary-secondary bending tool according to the invention.

The double/double fold folder 34 of FIG. 3 is formed from the pattern sheet 40 of FIG. 6 by essentially the same successive folding operations as the single/double fold folder 32 except that in the secondary folding operation, both folded longitudinal edge portions of the sheet are folded inwardly about their secondary fold lines 48*a* and progressively from the outfeed end 46 of the sheet to form the latter to its intermediate folded configuration of FIG. 14. The third folding operation then forms the tapered center fold 82, narrows the outfeed end of the sheet to form an outfeed mouth 84, and twists both longitudinal edge channels 52 approximately 90° about their longidutinal axes to form the double/double fold folder 34 of FIG. 3. This folder folds a binder strip 74 to its double/double folded configuration of FIG. 3*c* in which it is stitched to the fabric 76.

Reference is now made to FIGS. 17 to 26 illustrating primary-secondary and center bending tools according to the invention and to FIGS. 27 through 31 illustrating a tool according to the invention for forming the binder strip tensioning spring 66. FIGS. 17 through 22 illustrate the primary-secondary bending tool 100. This bending tool comprises a forming blade 104 and a backing or support blade 106. The forming blade 104 includes a long narrow forming bar 108 with an enlarged end 110. At the juncture of the forming bar 108 and enlarged end 110 are tapered shoulders 112.

The backing or support blade 106 is similar in shape to the forming blade 104 but is somewhat thicker and stronger than the forming blade. Thus, the support blade has a long narrow support bar 114 and an enlarged end having tapered shoulders 116 at the juncture of the support bar and the enlarged end.

The bending tool blades 104, 106 are joined to one another by a screw 118. This screw is threaded in the enlarged end of the support blade 106 and extends slidably through a hole 120 in the enlarged end 110 of the forming blade 104. Surrounding this screw is a compression spring 122 which seats against the screw head at one end and against the forming blade 104 at the opposite end for urging the tool blades together.

Figure 18:
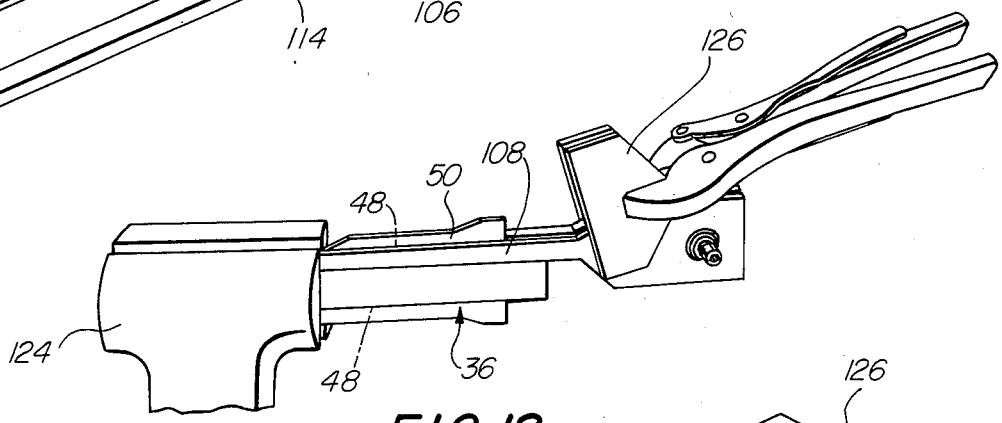
FIGS. 18–20 illustrate the bending tool of FIG. 17 being used to perform primary bending operations on the single fold pattern sheet of FIG. 4 for forming the latter to its initial configuration of FIG. 7.
Figure 19:
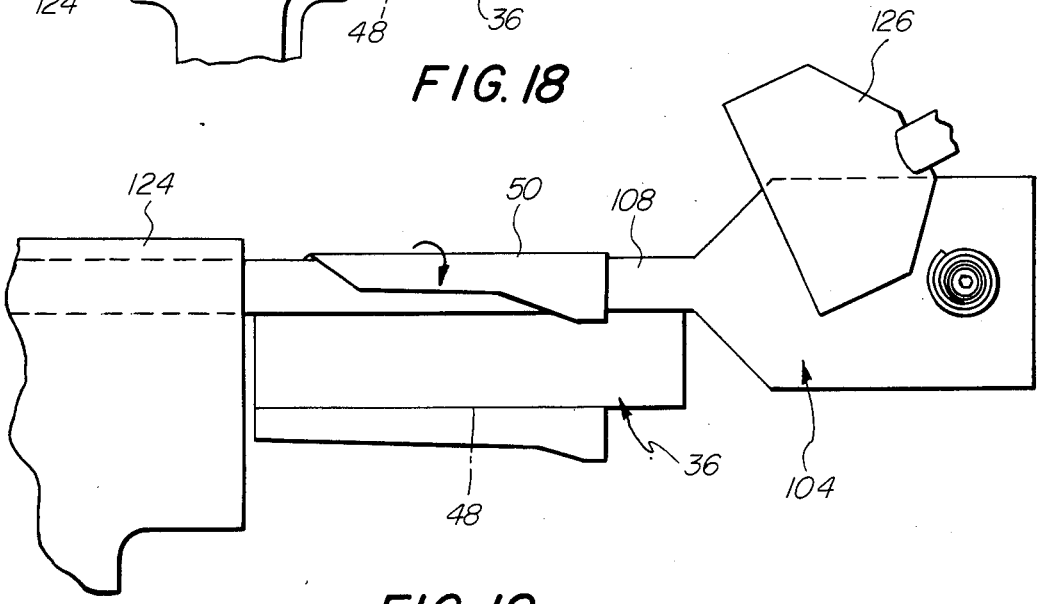
Figure 20:
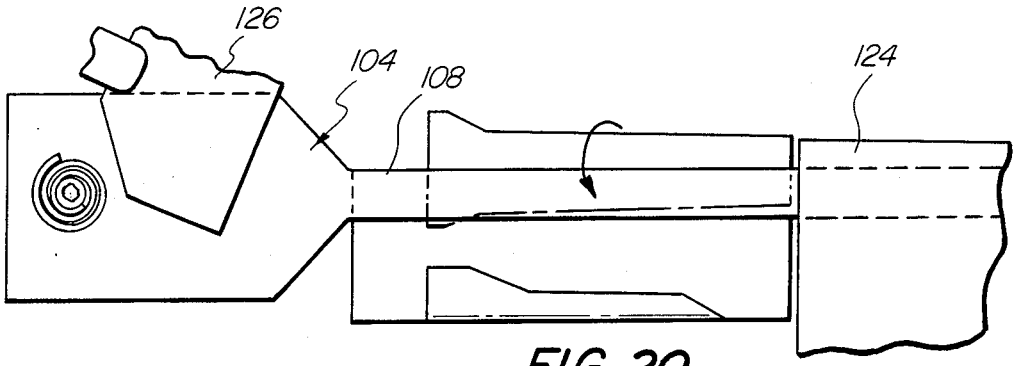

This primary-secondary bending tool 100 is used to perform the primary bending operation in the pattern sheets 36, 38 and 40 from which the described binder folders 30, 32, and 34 are formed. FIGS. 18 through 20 illustrate the use of the tool to bend the longitudinal edge portions 50 of the pattern sheet 36 from which is formed the single fold folder 30. The sheet is placed between the forming bar 108 of the forming blade 104 and the backing or support bar 114 of the support blade 106. The fold line 48 of the sheet is aligned with a longitudinal edge of the forming bar so that the adjacent longitudinal sheet edge portion 50 projects beyond the bar edge. The ends of the forming and support blades are now clamped tightly together in any convenient way, as by means of a vise 124 and a vise grip pliers 126, as shown in FIG. 18. At this point, the projecting sheet edge portion 50 is folded over the edge of the forming bar in any convenient way, as by gently tapping the edge portion with a rubber tipped mallet. The sheet is then clamped in the forming tool with the opposite edge portion 50 of the sheet projecting beyond an edge of the forming bar 108 and the edge portion is folded over the forming bar edge, as illustrated in FIG. 20. This bending operation places the pattern sheet 36 in its initial configuration of FIG. 7.

As mentioned earlier, the same bending operation is performed on the single/double and double/double folder pattern sheets 38 and 40. In the case of the pattern sheet 38, 40, however, the bending operations illustrated in FIGS. 18 through 20 are primary bending operations. Since these primary bending operations are made in the same way as described in connection with pattern sheet 36, no further description of the primary bending operations are necessary in connection with the pattern sheets 38, 40.

Figure 21:
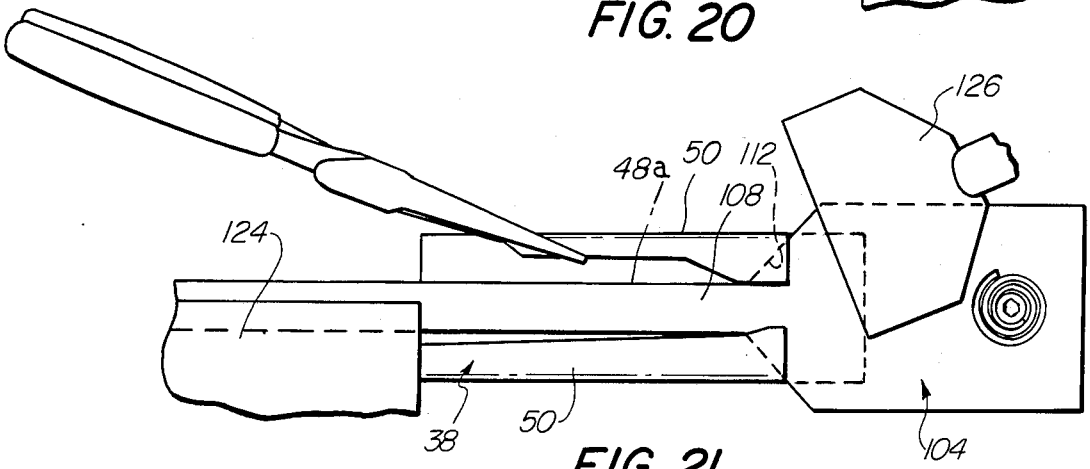
FIGS. 21 and 22 illustrate the bending tool of FIG. 17 being used to perform a secondary bending operation on the single/double fold pattern sheet of FIG. 5 for forming the latter to its folded configuration of FIG. 11.
Figure 22:
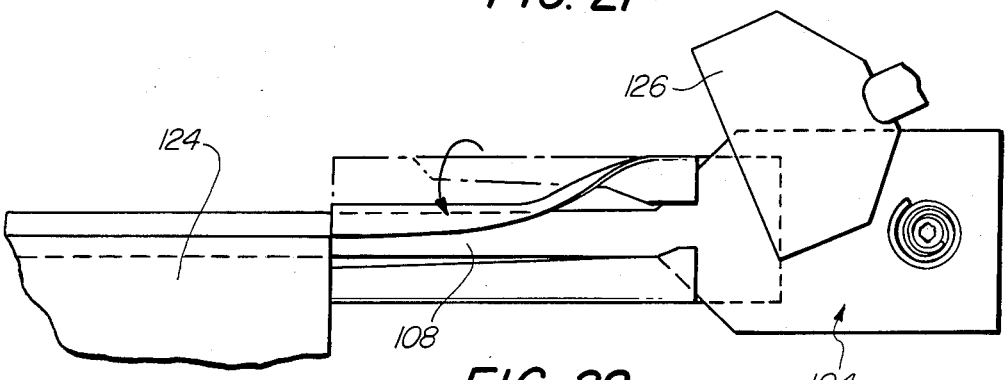

FIGS. 21 and 22 illustrate how the primary-secondary bending tool 100 is used to perform the single secondary bending operation in the single/double fold pattern sheet 38. The secondary bending operation is performed by aligning the secondary fold line 48*a* on the pattern sheet 38 with an edge of the forming bar 108 and sliding the sheet endwise along the bar to the position of FIG. 21, wherein the adjacent tapered shoulders 112 of the forming blade 104 project into the adjacent, infeed ends of the sheet channels 52. The opposite outfeed end of the projecting folded longitudinal edge portion of the sheet is then progressively bent over the forming bar 108 as shown in FIGS. 21 and 22 to form the sheet to its intermediate configuration of FIG. 11. Engagement of the tapered forming bar shoulders 112 within the infeed ends of the sheet channels 52 retains the infeed end of the sheet in its initial configuration of FIG. 7, wherein the infeed ends of the two channels are disposed in a common plane parallel to the flat intervening central sheet portion 54.

The same secondary bending operation is performed in the pattern sheet 40 for the double/double fold folder 34. In this latter case, however, the secondary bending operation is performed along each secondary bend line 48*a* of the sheet to form the latter to its intermediate folded configuration of FIG. 14.

FIGS. 23–26 illustrate the center bending tool 128 of the invention for forming the center folds 56, 78, 82 and the folders 30, 32, 34. The center bending tool includes arms 130, 132 joined at one end by a pivot 134. The opposite ends of the arms form handles 136. Arm 130 has two longitudinal forming cavities 138, 140 spaced along the arm. Cavity 138 is a relatively large cavity bounded by sidewalls 142 disposed in spaced parallel planes normal to the axis of the arm pivot 134. These sidewalls have upper edges 144 including portions 144*a* parallel to the arm 130 and inclined portions 144*b* which slope downwardly towards the latter arm. The outer sidewall surfaces are recessed as shown. The smaller forming cavity 140 is essentially identical to the forming cavity 138 except for size.

The center bending tool arm 132 includes a longitudinal forming blade 146 engageable in the forming cavity 138 and a longitudinal forming blade 148 engageable in the forming cavity 140. Projecting from opposite sides of the arm 132, just beyond the tapered ends of the sidewalls of the large forming cavity 138, are wings 150. These wings are disposed in a common plane parallel to the forming tool arm 146 and to the axis of the arm pivot 134. These wings are slotted edgewise at 152. Slots 152 enter the wing edges which face the cavity 138 and are disposed in the plane of the lower edge (in FIG. 23) of the forming blade 148. These latter wing edges have tapered shoulders 154 which converge toward the intervening folder arm 132. Similar wings 156 are provided on the forming tool arm 132 just beyond the tapered end of the smaller forming cavity 140.

Figure 23:
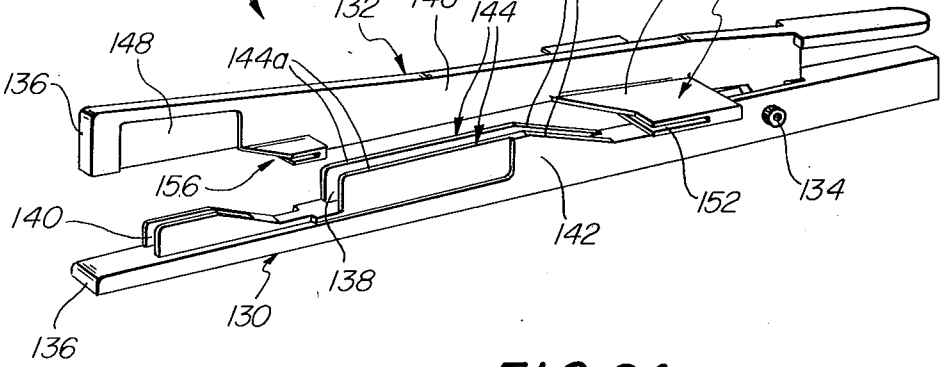
FIG. 23 is a perspective view of a center bending tool according to the invention.

In use of the center bending tool 128, a pattern sheet for one of the folders 30, 32, or 34, which has been bent to an initial configuration like that illustrated in FIG. 7, 11, or 14, as the case may be, is placed in the tool with the folded edge portions of the sheet facing the tool arm 130 in FIG. 23 and with the still flat central portion 54 of the sheet seating against the lower edge of the forming blade 146 or 148 on the arm 132, depending on the side of the folder to be formed. The sheet is moved edgewise along the arm 132 to engage the infeed end of the sheet in the slots 152 of the respective tool wings 154 or 156 as the case may be. In the ensuing description, it will be assumed that the pattern sheet to be formed is the single fold pattern sheet which has been formed to its initial configuration of FIG. 7 and that the sheet is placed in the forming tool 128 between the forming cavity 138 and its forming blade 146.

Figure 25:
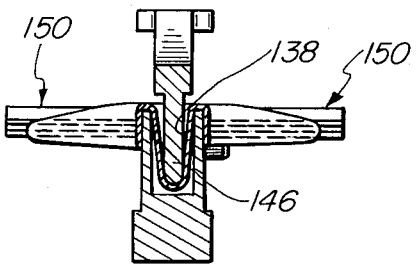
FIG. 25 is a section taken on line 25—25 in FIG. 24.
Figure 26:
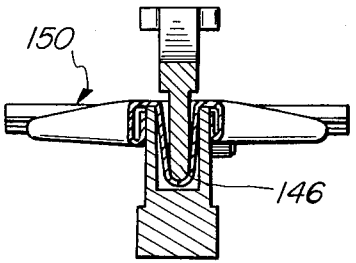
FIG. 26 is a section similar to FIG. 25 taken through the center bending tool during center bending of a double/double fold pattern sheet to the final folded configuration of FIG. 3.
Figure 24:
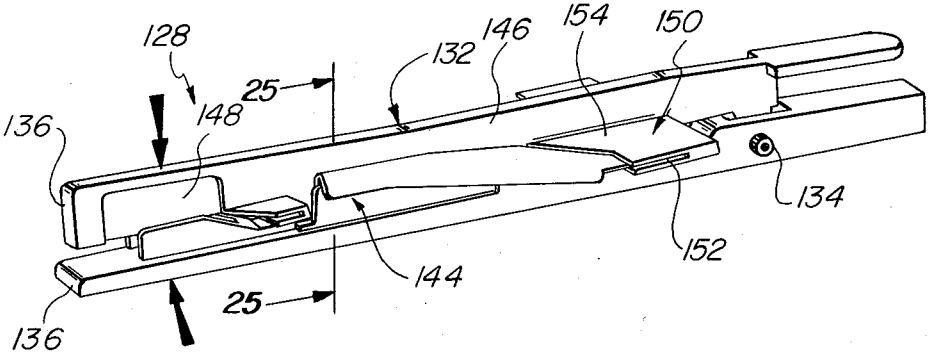
FIG. 24 illustrates the tool of FIG. 23 being used to center bend the single fold pattern sheet of FIG. 4 from its initial configuration of FIG. 7 to its final folded configuration of FIG. 1.
Figure 27:
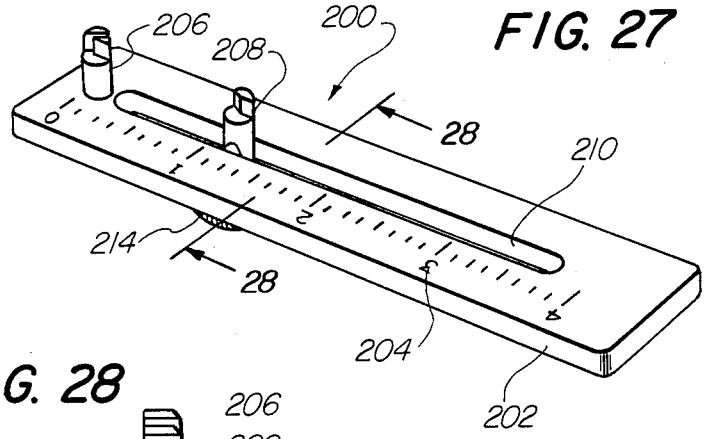
FIG. 27 is a perspective view of a tool according to the invention for forming a binder strip tensioning spring embodied in a completed binder strip folder attachment according to the invention.
Figure 28:
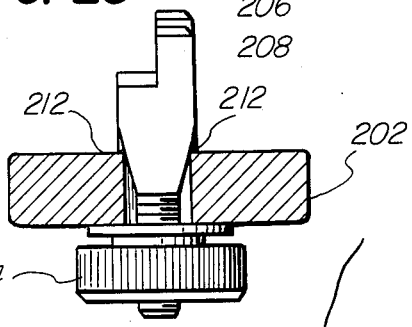
FIG. 28 is an enlarged section taken on line 28—28 of FIG. 27.

After the pattern sheet has thus been placed in the center bending tool 128, closing forces are exerted on the tool handles 136, as indicated by the arrows in FIG. 24. These forces drive the forming blade 146 into its forming cavity 138 thereby forcing the central portion 54 of the sheet into the forming cavity, as shown in FIG. 25. The forming cavity edge walls 142 are so tapered and the forming cavity 138 and its forming blade 146 are so sized as to bend the sheet in the manner described earlier and form the finished binder folder 30 of FIG. 1. Thus, the center bending tool is so constructed as to form the tapered center fold 56 and narrowed mouth 58 of the folder 30 and simultaneously twist the folder edge channels 52 about their longitudinal axes, while retaining the infeed end of the folder sheet in its initial configuration of FIG. 7. The center bending tool is used in a similar way to form the single/-double folder 32 of FIG. 2 and the double/double folder 34 of FIG. 3 from their folded pattern sheets of FIGS. 11 and 14. FIG. 26 is a cross-section through the bending tool at the completion of the center bending operation for the double/double folder 34.

The secondary bending operations performed by the primary-secondary bending tool 100 and the center bending operation performed by the center bending tool 128 may tend to collapse the longitudinal edge channels of the pattern sheet being bent. To avoid this, strips of material, such as crocus cloth, having approximately the same thickness and width of the binder strip to be folded, may be inserted through the folders bearing such secondary and center bending operations.

It will be evident from the foregoing description of the bending tools 100 and 128, that these tools may be used to form folders other than the single fold, single/-double fold, and double/double fold folders 30, 32 and 34 described. For example, the primary-secondary bending tool 100 may be used by itself to form a simple folder having only longitudinal edge channels.

Reference is now made to FIGS. 27 through 31 illustrating a bending tool for forming the serpentine binder strip tensioning spring 66 which forms part of the completed binder strip folder attachment. This spring forming tool comprises an elongate bar 202 bearing a dimensional scale 204. Fixed in one end of the bar 202, in line with the zero line on the scale 204, is an upstanding pin 206. A second upstanding pin 208 extends slidably through a central longitudinal slot 210 in the bar 202. Pin 208 has shoulders 212 which seat on the upper longitudinal edges of the slot 210 in FIG. 27. The lower end of the pin 208 is threaded to receive a knurled nut 214 which may be tightened to firmly clamp the pin 208 in a fixed position within the slot 210.

Figure 30:
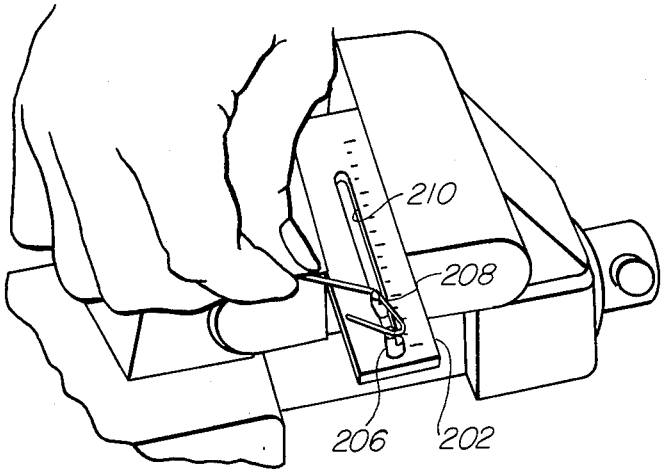
FIGS. 30 and 31 illustrate the use of the tool to form a binder strip tensioning spring.
Figure 29:
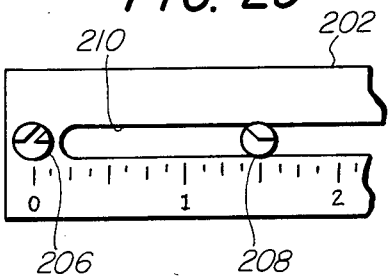
FIG. 29 is a fragmentary top plan view of the tool.
Figure 31:
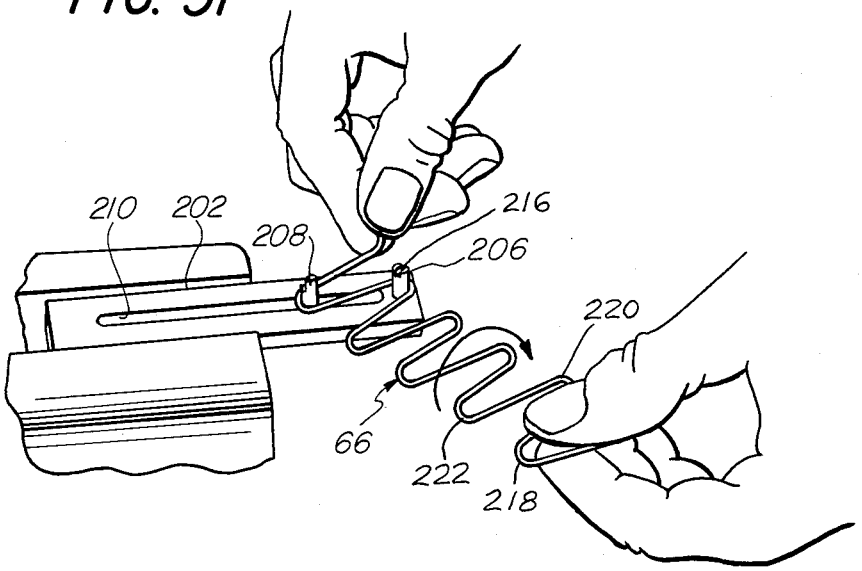

The adjustable pin 208 is adjusted along the bar 202 so that the spacing between this pin and the fixed pin 206 match the lateral width dimension W (FIG. 9) of the spring 66 to be formed. This width dimension W, in turn, is substantially equal to or slightly greater than the width of the binder strip 74 to be folded. The spring 66 is then formed by wrapping a spring wire about the pins in the manner shown in FIGS. 30, 31. More specifically, the spring is formed by engaging one end of the wire in a slot 216 in the fixed pin 206 and then bending the wire about the adjustable pin 208, as shown in FIG. 30, to form a first generally V-shaped bend 218. The wire is then turned over 180°, as indicated by the arrow in FIG. 31, and the first bend 218 is engaged about the pin 206. The wire is then bent around pin 208 to form a second V-shaped bend 220, after which the wire is again turned over, and the second bend is engaged about the pin 206. The wire is then again bent around the pin 208 to form a third bend 222, and so on until the desired number of bends have been made.

The inventors claim:

1. In a method of forming a binder folder, the steps comprising:

(a) providing a flat bendable sheet having longitudinal edges and opposite first and second ends, (b) bending longitudinal edge portions of said sheet inwardly over the same side of the sheet to form said sheet into a folded configuration having substantially coplanar longitudinal edge channels which open laterally inward toward one another and open longitudinally at their ends, and a relatively flat central sheet portion between and parallel to the common plane of said edge channels, (c) bending said sheet laterally and progressively from its first end toward its second end while retaining the second end portion of the sheet in said folded configuration, to form said central sheet portion into a laterally curved longitudinally extending and tapered fold which progressively decreases in height and increases in width from said first end toward said second end of the sheet and to twist said channels substantially about their longitudinal axes, thereby to form a folder body having a relatively narrow mouth at said first sheet end and twisted longitudinal channels having coplanar end portions at said second sheet end and opposite mouth ends which are angularly displaced about said channel longitudinal axes relative to said coplanar channel end portions, and wherein (d) said bending step (c) comprises placing said central sheet portion between a first forming bar having a longitudinal forming cavity with side walls whose thickness is no greater than the width of said folder edge channels, and a second forming bar having a forming blade engagable in said forming cavity and laterally projecting wings having edge slots in a common longitudinal plane of the second forming bar normal to the plane of and containing the leading edge of its forming blade, with said central sheet portion aligned with said forming cavity and said second sheet end engaging in said slots, and effecting relative movement of said forming blade into said forming cavity to deform said central sheet portion into said cavity and thereby form said sheet fold and twist said sheet edge channels, and (e) wherein a binder strip is adapted to be fed endwise through said folder body toward said folder mouth with the binder strip edges engaging within said channels to fold the binder strip laterally on itself.

2. In a method of forming a binder folder, the steps comprising:

(a) providing a flat bendable sheet having longitudinal edges and opposite first and second ends, (b) bending longitudinal edge portions of said sheet inwardly over the same side of the sheet to form said sheet into a folded configuration having substantially coplanar longitudinal edge channels which open laterally inward toward one another and open longitudinally at their ends, and a relatively flat central sheet portion between and parallel to the common plane of said edge channels, (c) twisting at least one longitudinal edge channel about the longitudinal axis of and progressively from the first end of the respective channel while retaining said second sheet end portion in said initial configuration by gripping said sheet between a forming blade having longitudinal edges and an enlarged end and a backing blade, with one channel-forming longitudinal edge portion of the sheet projecting beyond an edge of the forming blade and with said enlarged end of the forming blade engaging in the coplanar ends of said channels, and bending said one channel forming edge portion over the forming blade edge progressively from the first end of the respective edge channel.

3. The method of claim 2 including the further step of:

(d) bending said sheet laterally and progressively from its first end toward its second end while retaining the second end portion of the sheet in said folded configuration, to form said central sheet portion into a laterally curved longitudinally extending and tapered fold which progressively decreases in height and increases in width from said first end toward said second end of the sheet and to twist said channels substantially about their longitudinal axis, thereby to form a folder body having a relatively narrow mouth at said first sheet end and twisted longitudinal channels having coplanar end portions at said second sheet end and opposite mouth ends which are angularly displaced about said channel longitudinal axes relative to said coplanar channel end portions, and wherein (e) said bending step (c) comprises placing said central sheet portion between a first forming bar having a longitudinal forming cavity with side walls whose thickness is no greater than the width of said folder edge channels, and a second forming bar having a forming blade engagable in said forming cavity and laterally projecting wings having edge slots in a common longitudinal plane of the second forming bar normal to the plane of and containing the leading edge of its forming blade, with said central sheet portion aligned with said forming cavity and said second sheet end engaging in said slots, and effecting relative movement of said forming blade into said forming cavity to deform said central sheet portion into said cavity and thereby form said sheet fold and twist said sheet edge channels, and (f) wherein a binder strip is adapted to be fed endwise through said folder body toward said folder mouth with the binder strip edges engaging within said channels to fold the binder strip laterally on itself.

4. In a method of forming a binder folder, the steps comprising:

(a) providing a flat bendable sheet having longitudinal edges and opposite first and second ends, (b) bending longitudinal edge portions of said sheet inwardly over the same side of the sheet to form said sheet into a folded configuration having substantially coplanar longitudinal edge channels which open laterally inward toward one another and open longitudinally at their ends, and a relatively flat central sheet portion between and parallel to the common plane of said edge channels, (c) twisting both edge channels about the longitudinal axes and progressively from the first ends of the respective channels between said bending steps (b) and (c) while retaining said second sheet end portion in said initial configuration by gripping said sheet between a forming blade having longitudinal edges and an enlarged end and a backing blade with first one and then the other channel forming longitudinal edge portion of the sheet projecting beyond an edge of the forming blade and with said enlarged forming blade end engaging in the coplanar ends of said channels, and bending each channel forming edge portion over the forming blade edge progressively from the first ends of the respective channels.

5. The method of claim 4 including the further step of:

(d) bending said sheet laterally and progressively from its first end toward its second end while retaining the second end portion of the sheet in said folded configuration, to form said central sheet portion into a laterally curved longitudinally extending and tapered fold which progressively decreases in height and increases in width from said first end toward said second end of the sheet and to twist said channels substantially about their longitudinal axes, thereby to form a folder body having a relatively narrow mouth at said first sheet end and twisted longitudinal channels having coplanar end portions at said second sheet end and opposite mouth ends which are angularly displaced about said channel longitudinal axes relative to said coplanar channel end portions, and wherein (e) said bending step (c) comprises placing said central sheet portion between a first forming bar having a longitudinal forming cavity with side walls whose thickness is no greater than the width of said folder edge channels, and a second forming bar having a forming blade engagable in said forming cavity and laterally projecting wings having edge slots in a common longitudinal plane of the second forming bar normal to the plane of and containing the leading edge of its forming blade, with said central sheet portion aligned with said forming cavity and said second sheet end engaging in said slots, and effecting relative movement of said forming blade into said forming cavity to deform said central sheet portion into said cavity and thereby form said sheet fold and twist said sheet edge channels, and (f) wherein a binder strip is adapted to be fed endwise through said folder body toward said folder mouth with the binder strip edges engaging within said channels to fold the binder strip laterally on itself.

6. A folder forming tool, comprising:

an elongate flat forming blade including a longitudinal forming bar at one end having longitudinal edges and an opposite end portion which is enlarged edgewise of the forming blade and laterally of said forming bar, said enlarged end portion having tapered edges joining said forming bar edges and disposed at obtuse included angles relative to their respective forming bar edges, a backing blade disposed alongside said forming blade and having substantially the same shape and size as said forming blade, and means movably joining said blades at one end in a manner such that said blades may be urged together to clamp therebetween a metal sheet to be formed of said forming bar edges.

7. The forming tool of claim 6, wherein:

said joining means comprises a pivot pivotally connecting the enlarged ends of said blades, and a spring resiliently urging said blades together.

8. A folder forming tool comprising:

first and second forming bars, said first forming bar including a longitudinal forming cavity opening toward said second forming bar, said second forming bar including a longitudinal forming blade having a leading longitudinal edge facing said forming cavity, pivot means joining said bars for pivotal movement of said forming blade into and from said forming cavity, and said second forming bar also including wings between said forming blade and said pivot means projecting beyond opposite sides of said second forming bar in a common longitudinal plane of the bar parallel to said pivot axis and normal to the plane of the forming blade, and edgewise slots in said wings opening toward said forming blade and disposed in the plane of said forming blade edge.

9. The forming tool of claim 8, wherein:

said forming cavity has relatively thin side walls whose ends adjacent said pivot means taper toward the bottom of the cavity.

* * * * *